US009562306B2

(12) United States Patent
Sennewald et al.

(10) Patent No.: US 9,562,306 B2
(45) Date of Patent: Feb. 7, 2017

(54) FABRIC STRUCTURE WITH CELLULAR CONSTRUCTION

(71) Applicant: TECHNISCHE UNIVERSITÄT DRESDEN, Dresden (DE)

(72) Inventors: Cornelia Sennewald, Dresden (DE); Gerald Hoffmann, Nünchritz (DE); Chokri Cherif, Dresden (DE)

(73) Assignee: TECHNISCHE UNIVERSITÄT DRESDEN, Dresden (DE)

( * ) Notice: Subject to any disclaimer, the term of this patent is extended or adjusted under 35 U.S.C. 154(b) by 0 days.

(21) Appl. No.: 14/766,474

(22) PCT Filed: Feb. 6, 2014

(86) PCT No.: PCT/DE2014/100041
§ 371 (c)(1),
(2) Date: Aug. 7, 2015

(87) PCT Pub. No.: WO2014/121787
PCT Pub. Date: Aug. 14, 2014

(65) Prior Publication Data

US 2015/0368835 A1 Dec. 24, 2015

(30) Foreign Application Priority Data

Feb. 7, 2013 (DE) ..... 10 2013 101 219

(51) Int. Cl.
*D03D 11/00* (2006.01)
*D03D 15/00* (2006.01)
(Continued)

(52) U.S. Cl.
CPC ..... *D03D 25/005* (2013.01); *D03D 9/00* (2013.01); *D03D 11/00* (2013.01);
(Continued)

(58) Field of Classification Search
CPC .. E04B 9/0442; E04B 2009/0492; E04C 2/34; D03D 11/02; D03D 25/005; D03D 27/10; D03D 15/00
See application file for complete search history.

(56) References Cited

U.S. PATENT DOCUMENTS 1,516,571 A * 11/1924 Moore ..... C14B 7/04 156/254
3,138,506 A * 6/1964 Ross ..... B29C 70/44 156/147

(Continued)

FOREIGN PATENT DOCUMENTS

DE 102008036251 2/2010
EP 0299308 1/1989

OTHER PUBLICATIONS

International Search Report issued by the European Patent Office in International Application PCT/DE2014/100041.

(Continued)

*Primary Examiner* — Bobby Muromoto, Jr.
(74) *Attorney, Agent, or Firm* — Ursula B. Day; Law Firm of Ursula B. Day

(57) ABSTRACT

A fabric structure (1) having a cellular construction. The fabric structure comprises at least one base layer (6) consisting of warp threads (10), at least one top layer (7) consisting of warp threads (11) and weft threads (2) placed in between, wherein the fabric structure (1) is formed by a multiplicity of three-dimensional cells (3, 9) and the height (8) of each individual cell (3, 9) is defined by the spacing (8) between two warp threads (10, 11), located above the other in height direction z, in adjacent layers (6, 7), the length (12) of the cell (3, 9) is defined by the spacing (12) between two warp threads (10) or (11) adjacent in the weft direction x, in one layer (6, 7) and the width (13, 14) of a cell (3, 9) is defined by the extent (13) of the weft thread course in the (Continued)

warp direction y and/or the spacing (14) between the two weft threads (2) that are opposite in the warp direction y and adjacent to the particular cell (9). According to the invention, each weft thread (2) extends at least regionally in the fabric structure (1) in a dimensionally stable and three-dimensional manner and winds in the weft direction x about this axis (4) an imaginary, three-dimensional elongate hollow body, extending through the cells (3), having any desired end face (5). The weft threads (2) intersect the warp threads (10, 11) such that the weft threads (2) and warp threads (10, 11) retain one another and the fabric structure (1) is self-supporting.

18 Claims, 2 Drawing Sheets

(51) Int. Cl.
*D03D 25/00* (2006.01)
*D03D 15/02* (2006.01)
*D03D 9/00* (2006.01)

(52) U.S. Cl.
CPC ..... *D03D 15/0083* (2013.01); *D03D 15/02* (2013.01); *D10B 2101/20* (2013.01); *D10B 2403/021* (2013.01)

(56) References Cited

U.S. PATENT DOCUMENTS 3,481,427 A * 12/1969 Dobbs ..... F02K 1/827 181/292
4,840,828 A * 6/1989 Bottger ..... D06M 17/00 428/101
5,160,485 A * 11/1992 Jaillet ..... D03D 15/00 428/116
5,372,868 A * 12/1994 Prewo ..... E04C 2/34 428/120
5,387,455 A * 2/1995 Horsch ..... E04C 2/16 139/384 R
5,480,697 A * 1/1996 Bottger ..... D03D 27/10 139/386
5,534,318 A * 7/1996 Andre De La Porte ..... B29C 70/00 220/562
5,582,893 A * 12/1996 B ottger ..... D03D 27/10 428/102
5,763,035 A * 6/1998 Andre De La Porte ..... B29C 70/00 220/562
6,688,338 B2 * 2/2004 Meli ..... F16L 13/0272 138/123
7,048,985 B2 * 5/2006 Mack ..... B29C 70/24 428/105
7,051,489 B1 * 5/2006 Swiszcz ..... E04B 9/0442 160/84.05
7,060,156 B2 * 6/2006 Mack ..... B29C 70/24 156/161
7,194,846 B2 * 3/2007 Swiszcz ..... E04B 9/001 428/116
7,207,151 B2 * 4/2007 Swiszcz ..... E04B 9/001 428/116
7,303,641 B2 * 12/2007 Swiszcz ..... B31D 3/00 156/201
7,377,084 B2 * 5/2008 Swiszcz ..... E04B 9/001 428/116
7,398,624 B2 * 7/2008 Swiszcz ..... E04B 9/001 52/211
2010/0071300 A1 * 3/2010 Kang ..... B21F 3/02 52/646
2013/0157057 A1 * 6/2013 Haffelin ..... B29C 70/086 428/412
2014/0193625 A1 * 7/2014 Haffelin ..... B29C 70/086 428/217
2015/0174832 A1 * 6/2015 Wollenweber ..... B29C 70/34 156/297

OTHER PUBLICATIONS

Lee, Y.-H et al. A wire woven cellular metal: Part II, Evaluation by experiments and numerical simulations. Material & Design, 30, pp. 4459 to 4468 (2009).
Kieselstein et al. Cellular metals based on 3d-wire structures, CELLMET2008, 2d International Symposium, Oct. 8-10, 2008, Dresden.

* cited by examiner

*Stand der Technik*

FABRIC STRUCTURE WITH CELLULAR CONSTRUCTION

CROSS-REFERENCES TO RELATED APPLICATIONS

This application is the U.S. National Stage of International Application No. PCT/DE2014/100041, filed Feb. 6, 2014, which designated the United States and has been published as International Publication No. WO 2014/121787 and which claims the priority of German Patent Application, Serial No. 10 2013 101 219.1, filed Feb. 7, 2013, pursuant to 35 U.S.C. 119(a)-(d) the description of which is hereby incorporated by reference.

BACKGROUND OF THE INVENTION

The present invention refers to a fabric structure having cellular construction. This fabric structure is for example for use in light weight construction.

Typical cellular metallic light weight structures are metal foams. The production of metal foams is very time consuming and cost-intensive. There are light weight structures from lattice-shaped and honeycombed constructed polymer material. Lately, there is research activity on three-dimensional wire structures. Thus, at the Chonnam National University in South Korea experimental structures from wire helices were produced in a very complex six-axes production of a semi automated process as reported by Lee, Y.-H et al. A wire woven cellular metal: Part II, Evaluation by experiments and numerical simulations. Material & Design, 30, pp 4459 to 4468 (2009), as well as reported in Wire-woven bulk Kagome truss cores. Acta Materialia, 55 pp 6084 to 6094, (2007). These structures are however neither self-supporting nor stable against axial displacement but must be kept in a defined position and fixed by gluing, soldering or welding. A similar but much simpler production method is applied by the firm Kieselstein® in Chemnitz as it is known, among others, from Kieselstein et al. Cellular metals based on 3d-wire structures, CELLMET2008, 2d International Symposium, Oct. 8-10, 2008, Dresden. In this process specially formed wire spirals are wound together in a three-axes process into three-dimensional structures. This method is also very labor intensive and due to complex requirements not yet fully automated.

The structures known from the prior art are partly not self-supporting and not form-stable; that is, the single layers of the structures are partly axially displaceable against each other. None of the known structures can be produced fully automated, respectively, the production requires multi-step processes. An efficient commercial production can thus not be realized.

It is therefore an object of the present invention to provide cellular structures, which in particular correspond to the requirements for light weight construction and can be produced in automated processes.

SUMMARY OF THE INVENTION

The object of the present invention is thus accomplished by a fabric structure having a cellular construction. Such a fabric structure comprises at least a basis comprising warp threads at least a cover layer comprising warp threads and weft threads layered in between, wherein the fabric structure is formed by a multitude of three-dimensional cells, and the height of each single cell is defined by the distance between two in the height direction z superposed warp threads of adjacent layers, the length of the cell, by the distance between two in the weft direction x adjacent warp threads of a layer and the width of a cell by the extension of the weft thread course in warp direction y and/or by the distance between two, in warp direction y opposite and to the respective cell adjacent, weft threads. In accordance with the present invention, each weft thread in the fabric structure extends at least partly in form-stable three-dimensional manner winding itself along the weft direction x around an axis extending through a row of cells and thereby including an imaginary three-dimensional elongated hollow body with a varied end face around this axis and through a row of cells. Thereby, the weft threads are crossed with the warp threads in such a way that the weft threads and the warp threads hold each other and the fabric structure is self supporting.

The present invention allows thus to provide cellular three-dimensional, self supporting and stable, against axial displacement secured structures, in particular suited for light weight construction. The structures have cellular construction, and include enforcement material in three spatial directions, are self supporting and stable against axial displacement in all three directions x, y, z. In addition, the fabric structures can be from wire and from non-metallic materials. Through corresponding selection and combination of different materials available, the properties of the fabric structure can be direction-dependent defined and adjusted.

According to a further embodiment of the present invention, the fabric structure contains one or more additional cover layers, consisting at least of warp threads. Thus, multi-layered structures can be produced, whereby form-stable three-dimensional weft threads are also utilized to realize axial displacement stability. Thereby, the weft threads, in at least two planes, are placed between the at least two superposed cover layers, wherein a fabric structure is formed between the superposed cover layers by a multitude of three-dimensional cells. The height of each cell is defined by the distance between two, in the height direction z, superposed warp threads of adjacent layers, the length of the cell by the distance between two, in weft direction x adjacent warp threads of a layer, and the width of a cell, by the expansion of the weft thread course in warp direction y and/or by the distance between two, in warp direction y opposing, and adjacent each cell, weft threads. In the area of the fabric structure, between the superposed cover layers, each form-stable three-dimensional weft thread extends, at least in certain areas, by winding itself along the weft direction x around an axis which extends in weft direction x and through each of a row of cells and includes thereby an imaginary, through the row of cells extending three-dimensional elongated hollow body with a variable end face. The weft threads are crossed with the warp threads in such a way that the weft threads and warp threads hold each other and the fabric structure between the two superposed cover layers supports itself.

According to a preferred embodiment of the present invention, the imaginary three-dimensional hollow body has a plain cylindrical shape around which the form stable three-dimensional extending weft thread winds itself into a spiral along the weft direction x, preferably into a helix with an even rise. The spiral threads or the spiral wires realize the stability of the structure, especially with regard to their axial displacement stability.

Alternatively, the imaginary three-dimensional hollow body has a prismatic shape with a triangular end face along which the form-stable three-dimensional weft thread winds itself along the weft direction x in a zigzag line. As stated, the imaginary three-dimensional hollow body may have varied end face dimensions, thus it could be for example in the shape of a rectangle.

According to another embodiment of the present invention, form-stable three-dimensional extending threads can be weaved in warp direction y and that wind around an axis extending in warp direction y to enclose an imaginary three-dimensional elongated hollow body of any shape end face that extends around that axis and through the cells. The imaginary elongated hollow body can be shaped for example plain cylindrical, prismatic or rectangular and the corresponding additional threads or wires can wind around each of the imaginary hollow bodies depending on its shape in a spiral or in a zigzag line. Within a particular layer, form-stable three-dimensionally extending weft threads can be disposed and/or form-stable three-dimensionally extending threads in warp direction y with differently oriented direction, and if spiral shaped threads, with different rotational direction of the turns. Of course, the orientation direction of form-stable three-dimensionally extending threads of adjacent layers can also be varied.

According to a particular embodiment of the present invention, the fabric structure includes form-stable three-dimensional extending threads of the afore-stated kind in weft direction x on the one hand, and in the warp direction y on the other hand, multi-layered and crossed relative to each other. In other words, it means that form stable-three dimensional extending threads of the afore-stated kind in at least one layer are weaved into the structure exclusively as weft threads in weft direction x, and in the following layer, either above or below, exclusively in warp direction y.

In like manner, additional stretched and/or profiled threads of any form can be woven in warp direction y and/or in weft direction x. Preferably, the profiled threads are in two-dimensional triangular or trapezoidal shape. The profiled threads are advantageously tied by the warp threads of the base layer and the cover layer and/or—if several adjacent cover layers,—by the warp threads of these cover layers adjacent to each other and effect the distance between the base layer and the cover layer respectively between two adjacent cover layers.

Each thread of the fabric structure has a defined cross section geometric shape, which can be circular, triangular or rectangular. The thread of the fabric structure could be from metal or plastic. Preferably all threads of fabric structure can be in the form of wires and/or formed as yarn. Filaments or fiber yarn are preferably used as yarn.

Single warp threads can be provided that are distanced evenly or variably; the warp threads can however also be constructed as groups of warp threads, in particular, also as warp thread pairs lying closely together, wherein these closely together lying warp thread groups are distanced to other warp thread groups. Thereby, the distance between the warp thread groups in one layer in weft direction x each forms a cell length.

In a further variant of the present invention, the cover layers are weave-technologically densely formed. The distances between the warp threads and the distances between the weft threads are thereby the most minimal attainable, that is, the most dense packing results.

According to another embodiment of the present invention, the fabric structure contains rows of cells oriented in weft direction x with or without weft threads. According to an advantageous variant of the embodiment along the warp direction y and/or if several cover layers are present,—along the height direction z,—rows of cells oriented in weft direction x are alternately arranged with or without weft threads.

Furthermore, within the scope of the present invention fabric structures are possible, where the cell measures vary along the warp direction y and/or the weft direction x and/or—if there are several cover layers—along the height direction z.

An automated production of the structures can be realized in a modified weaving process. The structures, due to their stability are easy to handle and can be further processed in post-process steps. A further aspect of the present invention refers correspondingly to a process for producing a fabric structure according to the present invention, which includes, a a supply of at least two superposed layers of warp threads, b according to a special formation between the superposed warp threads, weft threads are weaved into, wherein each of the form-stable three-dimensional weft threads extends winding itself along the weft direction x around an axis which extends through a row of cells and includes thereby an imaginary three-dimensional elongated hollow body with a varied end face extending through those cells, c through the warp change a crossing results between warp and weft threads and d after the weaving process a take-down takes place in such a way that the fabric structure in z-direction is not irreversibly deformed.

Preferably the take-down takes place linearly without stress of the fabric structure or application of superposed rollers. Other forms of the take-down are also possible, where the fabric structure in z-direction is not irreversibly deformed, such as for example through application of needle rollers that are distanced relative to each other.

The take-down of wire structures takes place preferably by an intermittently linear working claw device. The fabric is clamped between two claws and synchronized to the weaving machine removed over a defined length. Thereafter, the clamping device is opened and placed back to the start and closed again. The removed fabric piece is cut off and stored.

The further processing of the fabrics takes place through the cutting and forming processes that usually take place in the textile industry respectively, in metal working sector.

A further aspect of the present invention refers to the use of the fabric structure according to the present invention as a light weight construction material for all of the afore-discussed embodiments. The structures can be applied as a light weight construction material and crash-, or energy-absorbing elements, among others in the field of mechanical engineering-, installations- and automotive construction, in the aerospace technology as well as in medical technology or in filtration technology. Fabric structures according to the present invention can be applied in architecture, where they are suitable for interior purposes as functional and/or design elements. The mechanical properties of the structure can be adjusted through various materials- or combinations as well as the size of the cells, that is the distances between the threads or the wires according to need.

BRIEF DESCRIPTION OF THE DRAWING

Further details, features and advantages of the present invention follow from the description below of examples of embodiments with reference to the accompanying drawings. It is shown.

DETAILED DESCRIPTION OF PREFERRED EMBODIMENTS

Figure 1A:
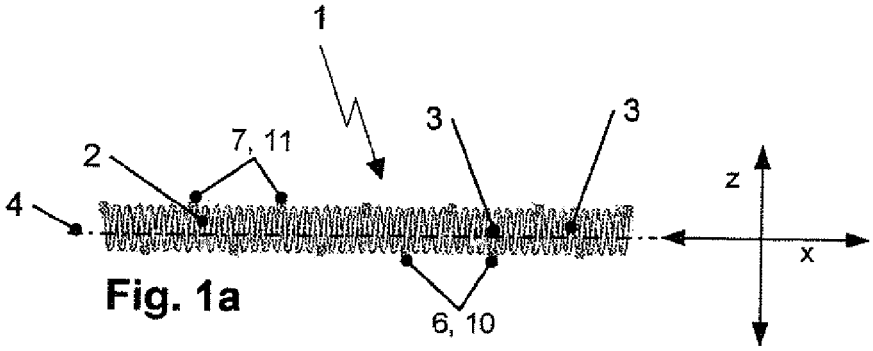
FIG. 1*a*: a side view of a schematically illustrated fabric structure according to the present invention along the weft direction x.

The drawings in FIGS. 1*a* to 1*d* represent only one of the possible arrangements for the reinforcement material. FIG. 1*a* shows a side view of a schematically illustrated fabric structure 1 along the weft direction x. The weft thread 2 is a so-called spiral wire 2. As FIG. 1*a* shows in combination with the side view of FIG. 1*b* along the warp direction y, this weft thread extends three-dimensional form-stable and winds itself along the weft direction x around an axis 4 extending in weft direction x and through each row of cells 3. Thereby, the weft thread 2 encloses around this axis 4 an imaginary three-dimensional elongated hollow body with a circular-shaped end face 5 around which the form-stable, three-dimensional weft thread winds in a spiral manner in the weft direction x.

Figure 1B:
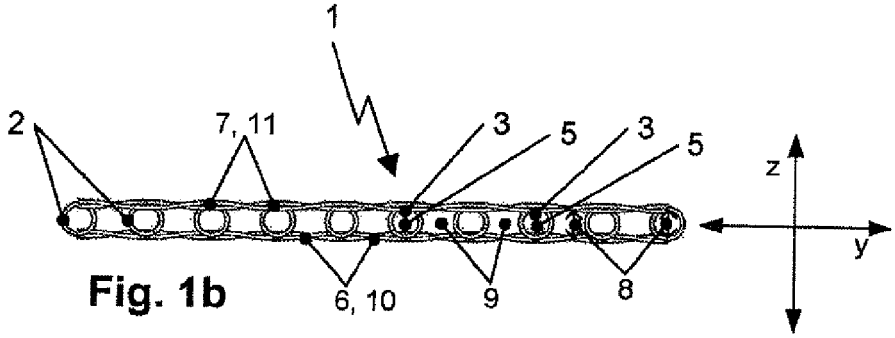
FIG. 1*b*: a side view of the fabric structure along the warp direction y.

In addition, FIGS. 1*a* and 1*b* show in the side views of the fabric structure 1 in weft direction x and in warp direction y, a base layer 6 and a cover layer 7 between which several form-stable spiral-shaped weft threads 2 are weaved in. The fabric structure 1 is constructed in cellular manner. According to FIG. 1*b*, besides cells 3, through which a weft thread 2 extends, there are cells 9 through which no weft thread extends. The height 8 of each single cell 3, 9 is defined by the distance 8 between two, in height direction z superposed warp threads 10, 11 of the adjacent layers 6 and 7.

Figure 1C:
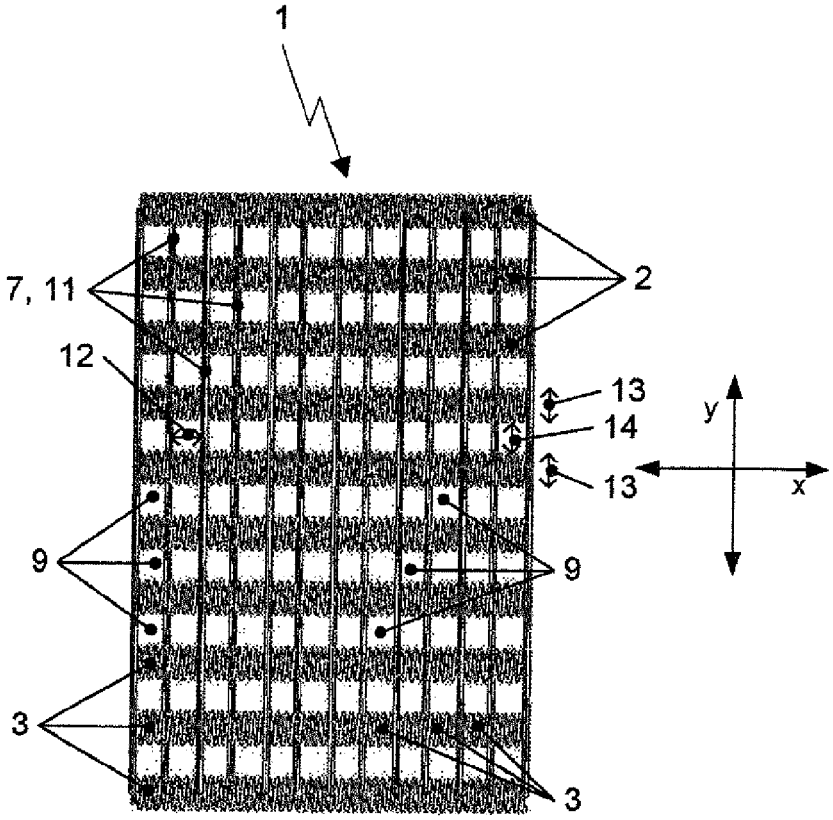
FIG. 1*c*: a top view of the fabric structure.

FIG. 1*c* shows a top view onto the fabric structure 1, wherein in this top view the warp threads 11 of the cover layer 7 and the weft threads 2 are crossed. The combination view of FIGS. 1*c* and 1*b* shows that the fabric structure 1 is constructed of a multitude of three-dimensional cells 3, 9. FIG. 1*c* shows the length 12 of cells 3, 9 as the distance 12 between two in weft direction x adjacent warp threads 11 of a layer 7, in this case, the cover layer 7. But as length 12 of cells 3, 9 also counts the distance 14 between two, in weft direction x adjacent warp threads 10 of the base layer 6 (not shown in FIG. 1*c*, compare FIG. 1*b*).

Compared to this, FIGS. 1*b* and 1*c* show that in case of cells 3 with weft thread 2, the width 13 of these cells 3 are each defined through the expansion 13 of the weft thread course in warp direction y. In case of cells 9 without the weft thread 2, the width 14 of a cell 9 results from the distance 14 of a cell 9 by each, the distance 14 between two, in warp direction y oppositely positioned and adjacent to cell 9, weft threads 2.

The distances 8 between the layers 6, 7 or between the warp threads 10, 11 as well as the number and arrangement of weft threads 2 can be varied any which way. According to the schematically illustrated embodiment in FIGS. 1*a* to 1*c*, the warp threads 10, 11 and also the weft threads 2 are formed as wires 2.

Figure 1D:
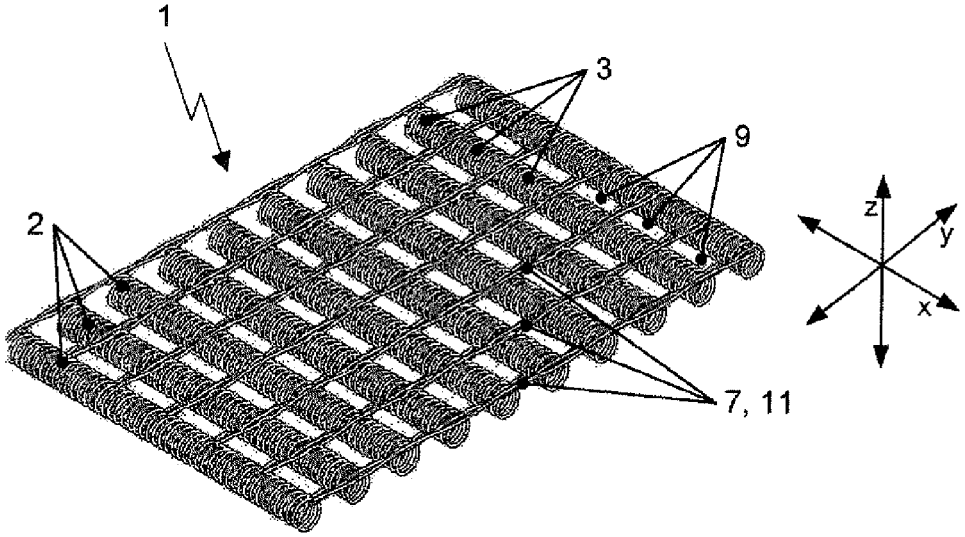
FIG. 1*d*: a perspective view of the fabric structure

FIG. 1*d* shows a perspective, schematic view in all three spatial directions x, y, z of the fabric structure 1 in accordance with the present invention having a cellular construction. Shown are the weft threads 2 which cross with the warp threads 11 of cover layer 7, thereby forming cells 3, 9.

Figure 2:
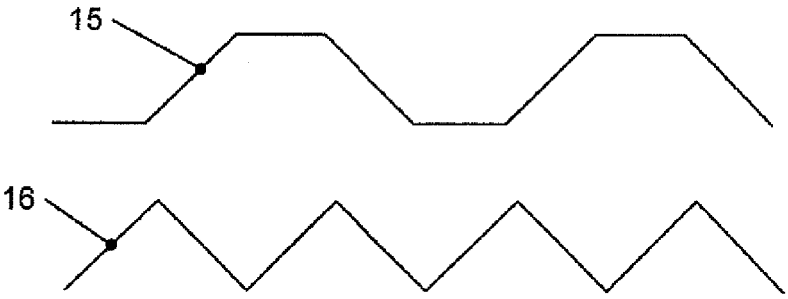
FIG. 2: profiled threads having trapezoidal- and triangular profile, prior art.

In addition to the spiral wires, stretched threads extending straight and profiled threads 15, 16 known from the prior art, or wires, for example with trapezoidal profile 15 or triangular profile 16 as shown in FIG. 2, can be processed. The single wires can be combined locally in different ways. A subsequent reshaping of the structures to single or multiple bent structures can be also realized.

What is claimed is:

1. A fabric structure having a cellular construction comprising, at least one base layer of warp threads, at least one cover layer of warp threads and weft threads interposed therebetween, said cellular construction including a multitude of three-dimensional cells, each having a height, a length and a width dimension, wherein the height is defined by the distance between two superposed warp threads in an adjacent layer in a height direction z, the length defined by the distance between two, in a weft direction x adjacent warp threads or adjacent layer, and the width defined by the expansion of the weft thread course in warp direction y and/or, by the distance between two, in warp direction y, opposite weft threads and adjacent to each cell, wherein at least area-wise, each weft thread extends form-stable three-dimensional along the weft direction x winding around an axis that extends each through a row of cells and defines an three-dimensional elongated hollow body having a variable-shaped end face, said hollow body extends through the row of cells and wherein the weft threads are crossed with each other in such a way that the weft threads and the warp threads hold each other and renders the fabric structure self supporting.

2. The fabric structure according to claim 1, further comprising one or more additional cover layers and wherein weft threads are interposed between each of the more than one additional cover layers, and wherein the cells are between each of the layers.

3. The fabric structure of claim 1, wherein the, in weft direction x form-stable three-dimensional extending, weft thread is wound around the three-dimensional hollow body in a spiral manner so as to define a plain cylindrical shaped hollow body.

4. The fabric structure of claim 1, wherein the, in weft direction x form-stable three-dimensional extending, weft thread is wound around the three-dimensional hollow body in a zigzag manner so as to define a prismatic shaped hollow body with a triangular end face.

5. The fabric structure of claim 1, wherein additional form-stable three-dimensional threads that are wound around an axis along the warp direction y defining the three-dimensional elongated hollow body extending through the cells with a variable shaped end face, are weaved in warp direction y.

6. The fabric structure of claim 1, wherein form-stable three-dimensional extending weft threads and/or form-stable three-dimensional threads are disposed in warp direction y at various orientations within one of the layers.

7. The fabric structure of claim 1, wherein additionally stretched and/or profiled threads of variable form are weaved in warp direction y and/or in weft direction x.

8. The fabric structure of claim 7, wherein the profiled threads have a two-dimensional triangular or trapeze shape.

9. The fabric structure of claim 7, wherein the profiled threads are tied-up by the warp threads of the base layer and the cover layer and/or layers adjacent to each other and thus effect the distance between the base layer and the cover layer and/or between two adjacent cover layers.

10. The fabric structure of claim 9, wherein all threads have defined cross sectional shapes.

11. The fabric structure of claim 10, wherein the shapes are circular, triangular or rectangular.

12. The fabric structure of claim 9, wherein the threads are of metal or plastic.

13. The fabric structure of claim 9, wherein all threads are wire and/or yarn.

14. The fabric structure of claim 13, wherein the yarn is a fiber yarn or a yarn in the form of filaments.

15. The fabric structure of claim 1, wherein the rows of cells oriented in weft direction x are arranged with or without weft threads.

16. The fabric structure of claim 2, wherein the rows of cells oriented in weft direction x, along the warp direction y and/or, if there are several cover layers, along the height direction z are alternately arranged.

17. The fabric structure of claim 1, wherein the cell measurements along the warp direction y and/or the weft direction x and/or—if there are more than one cover layer—varies along the height direction z.

18. A method of using the fabric structure of claim 1, comprising incorporating a finished structure within a light weight construction.

* * * * *